US010196939B2

(12) United States Patent
Schüle et al.

(10) Patent No.: US 10,196,939 B2
(45) Date of Patent: Feb. 5, 2019

(54) METHOD FOR LOW LOAD OPERATION OF A POWER PLANT WITH A ONCE-THROUGH BOILER

(71) Applicant: ALSTOM Technology Ltd, Baden (CH)

(72) Inventors: Volker Schüle, Leimen (DE); Stephan Hellweg, Oetigheim (DE); Reinhard Leithner, Braunschweig (DE); Niels Brinkmeier, Braunschweig (DE)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 298 days.

(21) Appl. No.: 14/807,216

(22) Filed: Jul. 23, 2015

(65) Prior Publication Data

US 2016/0032784 A1 Feb. 4, 2016

(30) Foreign Application Priority Data

Jul. 29, 2014 (EP) ..... 14179002

(51) Int. Cl.

| | |
|---|---|
| ***F01K 7/34*** | (2006.01) |
| ***F01K 7/24*** | (2006.01) |
| ***F22B 35/10*** | (2006.01) |
| ***F22D 1/32*** | (2006.01) |
| ***F01K 9/02*** | (2006.01) |
| ***F22B 29/06*** | (2006.01) |

(52) U.S. Cl.

CPC ..... *F01K 7/345* (2013.01); *F01K 7/24* (2013.01); *F01K 9/023* (2013.01); *F22B 29/06* (2013.01); *F22B 35/101* (2013.01); *F22D 1/32* (2013.01)

(58) Field of Classification Search

CPC ..... F03G 6/003; F01K 7/345; F01K 9/023; F01K 11/00; F22B 29/06

See application file for complete search history.

(56) References Cited

U.S. PATENT DOCUMENTS 3,550,562 A * 12/1970 Strohmeyer, Jr. ..... F22B 35/101 122/448.4

4,003,205 A 1/1977 Matsumura (Continued)

FOREIGN PATENT DOCUMENTS

DE 10 2009 036064 A1 2/2011
EP 0 195 326 A1 9/1986

(Continued)

*Primary Examiner* — Mark Laurenzi
*Assistant Examiner* — Shafiq Mian
(74) *Attorney, Agent, or Firm* — GE Global Patent Operation; Marc A. Vivenzio

(57) ABSTRACT

The once-through boiler includes a water supply and at least an economizer, an evaporator superheater. No valves are provided between the economizer, the evaporator and the superheater. The high-pressure turbine includes a control valve. The method for low load operation of a power plant with a once-through boiler and a high pressure turbine includes providing a parameter indicative of the stable operation of the once-through boiler in once-through operation, and on the basis of this parameter adjusting the control valve in order to regulate the pressure within the economizer and evaporator and/or adjusting the temperature of the water supplied to the economizer.

11 Claims, 1 Drawing Sheet

(56) References Cited

U.S. PATENT DOCUMENTS

| | | | | | |
|---|---|---|---|---|---|
| 4,455,614 | A * | 6/1984 | Martz | F01K 23/10 | 290/40 R |
| 4,896,498 | A * | 1/1990 | Knizia | F01K 23/067 | 60/39.12 |
| 4,909,037 | A * | 3/1990 | Hubby | F22B 35/10 | 122/448.4 |
| 5,435,138 | A * | 7/1995 | Silvestri, Jr. | F01D 5/00 | 60/652 |
| 6,782,703 | B2 * | 8/2004 | Dovali-Solis | F02C 6/18 | 60/39.182 |
| 8,857,455 | B2 * | 10/2014 | Minuth | G05D 23/1386 | 122/459 |
| 9,316,122 | B2 * | 4/2016 | Labbe | F01K 7/40 | |
| 9,382,848 | B2 * | 7/2016 | D'Amato | F01K 7/40 | |
| 9,388,978 | B1 * | 7/2016 | Soltys | F23J 11/00 | |
| 9,739,478 | B2 * | 8/2017 | Rancruel | F22G 3/00 | |
| 2004/0045300 | A1 * | 3/2004 | Dovali-Solis | F02C 6/18 | 60/778 |
| 2010/0275609 | A1 * | 11/2010 | Snider | F02C 3/305 | 60/773 |
| 2011/0150716 | A1 * | 6/2011 | Wada | B01D 53/8631 | 422/173 |
| 2012/0285175 | A1 * | 11/2012 | Fletcher | F02C 3/305 | 60/775 |
| 2013/0152586 | A1 * | 6/2013 | Mishima | F01K 23/10 | 60/641.8 |
| 2013/0180474 | A1 * | 7/2013 | Wilhelm | F28F 9/013 | 122/406.4 |

FOREIGN PATENT DOCUMENTS

| | | |
|---|---|---|
| EP | 2 546 476 A1 | 1/2013 |
| EP | 2 716 880 A1 | 4/2014 |

* cited by examiner

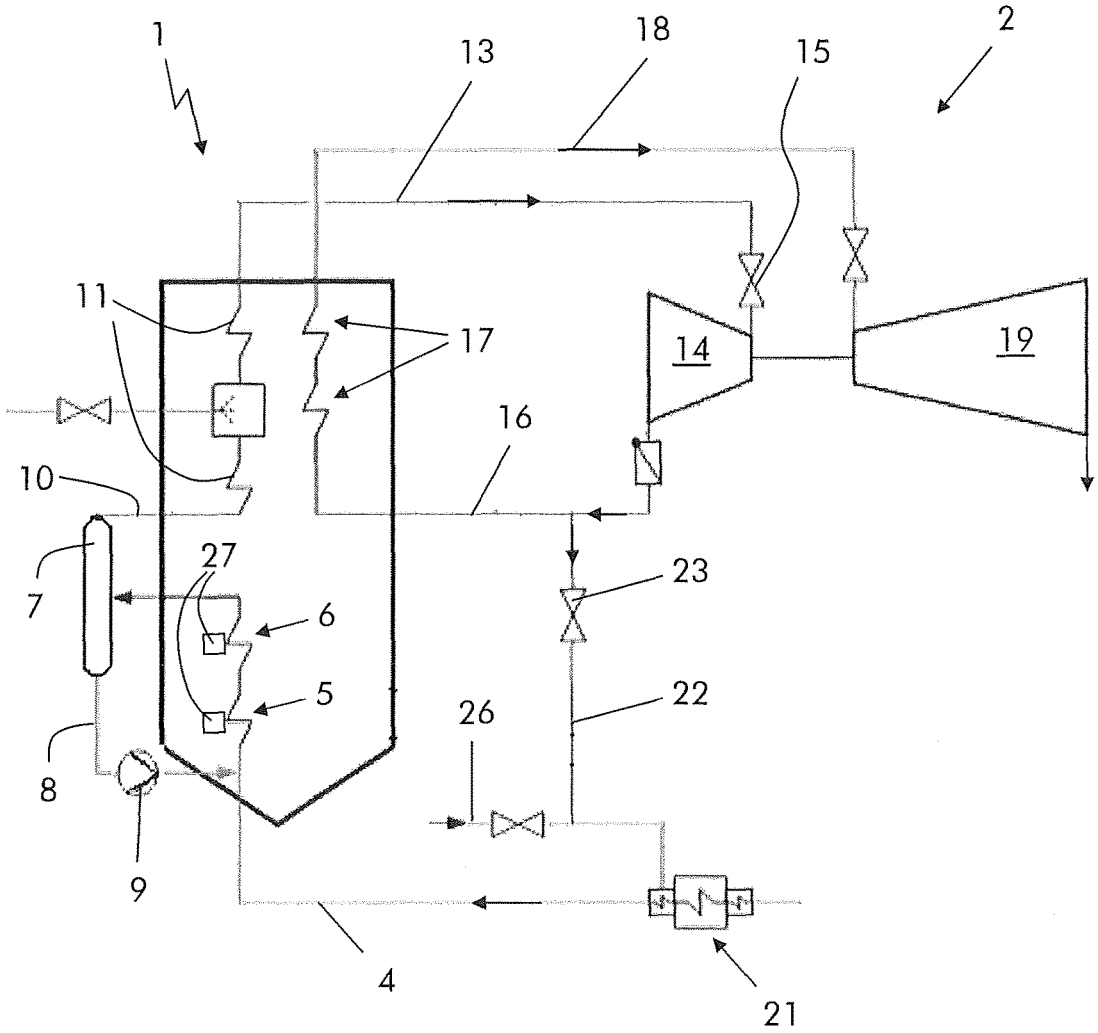
1
2
13
18
15
11
17
14
19
16
10
7
27
6
5
23
22
26
8
9
4
21

METHOD FOR LOW LOAD OPERATION OF A POWER PLANT WITH A ONCE-THROUGH BOILER

CROSS-REFERENCE TO RELATED APPLICATIONS

This application claims priority to EP Application No. 14179002.2 filed Jul. 29, 2014, the contents of which are hereby incorporated in its entirety.

TECHNICAL FIELD

The present invention relates to a method for low load operation of a power plant with a once-through boiler. The power plant is typically a power plant for production of electricity and the once-through boiler is part of a steam cycle comprising, in addition to the once-through boiler, a turbine (usually a high-pressure turbine, a medium-pressure turbine and/or a low-pressure turbine), a condenser and a pump.

BACKGROUND

Once through boilers are boilers in which the operating fluid such as water is vaporized and superheated in one passage through the boiler, without a separation step of steam from water.

FIG. 1 shows a typical power plant set up with a once-through Boiler 1 and a steam turbine 2.

The boiler 1 has a water supply 4 connected to an economizer 5 in turn connected to an evaporator 6 in turn connected to a separator 7 (for forced circulation operation). A line 8 with a pump 9, is connected between the separator 7 and the water supply 4, and a line 10 is connected between the separator 7 and a superheater 11. A line 13 is provided between the superheater 11 and a high-pressure turbine 14; the line 13 is provided with a control valve 15. Usually also a closing valve (for safety reasons) is provided, the closing valve is not shown in the drawings; in addition, the control valve and the closing valve can be both embedded in one body.

A line 16 is provided between the high-pressure turbine 14 and a reheater 17 and a line 18 connects the reheater 17 to a medium-pressure and/or low-pressure turbine 19. Downstream of the turbine 19 a condenser is provided (not shown). In other cases, downstream of the turbine 19 another steam consumer might be installed.

The boiler 1 does not have valves between the different boiler sections (economizer 5, evaporator 6, superheater 11, reheater 17); it is anyhow clear that the method can also be implemented on boilers (1) that are equipped with these valves.

Usually, the water supply 4 is connected to a preheater (condenser), preferably without mixing of the fluids involved, for pre-heating the water supplied to the economizer 5. The preheater 21 is connected via an extraction line 22 having a regulation valve 23 to the line 16, for supplying steam from the line 16 into the preheater 21; at the preheater 21 the steam is condensed (but the steam is not mixed with the water) to preheat the water supplied to the economizer 5.

Normal Operation

During normal operation, water is heated at the preheater 21 by condensing steam from the line 16. The steam is not mixed with the water (i.e. at the condenser 21 steam and water are maintained separated from each other). The heated water is then supplied via the water supply 4 to the economizer 5 and evaporator 6; at the evaporator 6 water is completely evaporated, such that from the evaporator 6 steam, usually superheated steam, is supplied into the separator 7.

During normal operation, the forced circulation operation is out of service and the circulation pump 9 is switched off.

The steam from the separator 7 is thus further superheated in the superheater 11 (shown in the drawing in two sections with a spray water attemperator in between) and then expanded in the high-pressure turbine 14. The steam discharged from the high-pressure turbine 14 is then reheated in the reheater 17 and further expanded in the turbine 19 and is then forwarded to the condenser of the steam cycle (not shown in FIG. 1). The condensed fluid is returned to the boiler.

Low Load Operation

When once through boilers are being operated at low load, the water supplied via the water supply 4 is reduced, in order to reduce the steam mass flow generated at the boiler 1 and supplied to the high-pressure turbine 14 and medium/low-pressure turbine 19.

Anyway, below a certain load, the water flow supplied via the water supply 4 becomes so small, that stable operation of the boiler 1 cannot be guaranteed any longer. For example, when the water flow becomes too low, at the evaporator and/or economizer high tube wall temperatures and/or temperature differences in tube walls and between tubes may occur, due to problems such as departure from nuclear boiling and/or static instability and/or too low static stability of the water flow; other problems that may occur are different flows in different tubes and/or flow dynamic instability, fluctuating flows and/or pressures and/or temperatures.

Too small a flow via the water supply 4 through the economizer and evaporator shall thus be avoided.

Traditionally, in order to avoid operation with a too small water/steam flow through the economizer and evaporator, the boiler is switched from once-through operation (described above) to forced circulation operation.

In forced circulation operation, the water supply 4 feeds a higher water mass flow to the economizer 5 and evaporator 6 than the water mass flow that can be evaporated with the currently supplied fuel required for the current load.

The evaporator 6 thus only partially evaporates the water and provides the separator 7 with a mixture of water and steam.

The water is collected at the bottom of the separator 7 and is fed back by the pump 9 upstream of the evaporator 6 or economizer 5 (e.g. FIG. 1 shown supply via line 8 upstream of the economizer 5).

This way it is possible to maintain a water/steam flow through the evaporator 6 and economizer 5 or only the evaporator 6 greater than the water/steam flow needed at that load, such that the water mass flow passing through the economizer 5 and/or evaporator 6 is high enough to guarantee reliable operation without damages of the boiler.

Nevertheless, during forced circulation operation, the steam collected at the separator 7 is not superheated because the water/steam system is in the wet steam area.

Since the steam in the separator 7 is not superheated, as it would be the case in once through operation, the steam temperature at the outlet of the evaporator 6 drops significantly compared to once-through operation, leading to a reduced steam temperature also at the outlet of the superheater 11.

These temperature excursions are detrimental to the material life time, it is therefore desirable to maintain the once-through operation for the boiler also at low load or at least reducing the limit load where switching over to forced circulation operation is necessary.

In addition, when at low load the steam temperature at the superheater outlet is kept closer to the nominal temperature, re-ramp rates could be adjusted to much higher gradients. When at lower load forced circulation is not required, the time consuming switch over process from forced circulation to once-through operation is also no longer required. With this switch over process being made redundant, the time period that is necessary to ramp the unit back up to nominal load coming from low load is reduced.

SUMMARY

An aspect of the invention includes providing a method that permits once-through operation of a boiler at low load, without the need of shifting its operation to forced circulation operation or allowing a reduction of the limit load where shifting to forced circulation operation for reliable operation of the boiler is needed.

Another aspect of the invention is to provide a method by which boilers that are not equipped with a forced circulation system, can be operated at low load.

Typically once-through boilers can be operated in once-through mode to a load as low as 35-40% of the nominal load; below this load shifting to forced circulation operation is required. According to the invention once-through boilers can undergo once-through operation also at a load below 35-400 of the nominal load. It is clear that for particular boilers the limit load could also be different from 35-40%, e.g. lower than 35-40% of the nominal load; the limit load is thus defined by the stable and safe operation of the boiler and the individual boiler design.

These and further aspects are attained by providing a method in accordance with the accompanying claims.

Surprisingly the inventors have discovered that the regulation of the pressure and/or temperature of the water/steam at the economizer and/or evaporator inlet allow reliable operation of the boiler in once-through operation without damages also at load lower than the originally defined limit load.

BRIEF DESCRIPTION OF THE DRAWINGS

Further characteristics and advantages will be more apparent from the description of a preferred but non-exclusive embodiment of the method, illustrated by way of non-limiting example in the accompanying drawings, in which:

FIG. 1 shows a once-through boiler for implementing the method of the invention.

DETAILED DESCRIPTION OF EXEMPLARY EMBODIMENTS

The method is described with reference to a once-through boiler like the one shown in FIG. 1 and described above.

The method can be implemented at start up, from a certain minimum load of the boiler onwards or when operating the boiler at low load.

The method comprises providing at least a parameter indicative of the stable operation of the once-through boiler in once-through operation and, on the basis of this at least a parameter, adjusting the control valve 15 in order to regulate the pressure within the once-through boiler 1 and/or adjusting the temperature of the water supplied from the water supply 4 to the economizer 5. The parameter indicative of stable operation can be taken from a measurement system that the evaporator and/or economizer is equipped with, or from a software model of these systems.

Different parameters can be used.

For example, a critical load of the boiler or pressure or temperature of the steam within the boiler can be defined, the control valve 15 can then be adjusted on the basis of the current load or pressure or temperature. With reference to the load, when the load falls below the critical load the control valve 15 is closed from fully open position to a partial closed position. Also a number of critical loads can be defined and a number of partial opening positions can be associated to these critical loads, such that when the load falls below a given load, the control valve is closed accordingly. All parameter adjustments as described will be made in order to enable extended once through operation at loads lower than the load were the switch over to forced circulation mode was required without these adjustments.

In a preferred embodiment, providing the parameter comprises measuring at least a temperature at the evaporator and/or economizer.

Different possibilities for this measurement can be envisaged and the measurement can include one or more of the following measurements:

(1) a temperature spread between different tubes and/or tube bundles and/or tube sections of the evaporator and/or economizer; the evaporator and the economizer have a number of tubes, measuring the temperature of different tubes of the evaporator and/or economizer, or different bundles of tubes of the evaporator and/or economizer and/or tube sections of the evaporator and/or economizer gives an indication on how uneven the flow through different tubes and/or different bundles of tubes and/or different sections the flow is and the effect of this unevenness on the temperatures;

(2) a plurality of temperatures over at least a tube of the evaporator and/or economizer; this measurement gives the differential temperature in the wall of given tubes; this measurement allows when knowing the distance between the measurements and the thermal conductivity of the tube material to conclude on the heat flux rate over the tube; likewise the heat flux can also be measured, when the temperature is measured at different radiuses of the tube wall of a tube.

(3) a temperature fluctuation of at least a tube of the evaporator and/or economizer over time; this measurement gives an indication of the temperature fluctuations over time.

Advantageously, a direct measurement of the temperature in a number of positions according to the points (1)-(3) above allows to operate the boiler with reduced safety margins but in safe conditions.

Adjusting the control valve 15 typically includes operating the boiler with control valve 15 partially closed, in order to increase the pressure within the economizer 5 and evaporator 6 (typically the control valve 15 at full load is completely open or close to fully open). With sliding pressure operation, the valve 15 would stay open also at load points below nominal load. Operation with control valve 15 partially closed in not a transient operation, but at low load operation is a way to control the minimum pressure value in the economizer 5 and evaporator 6, prescribed for the individual boiler design. With this invention, pressure values above the minimum pressure value shall at low load be adjusted with the target to enable extended once-through operation at lower firing rates. The set point to which the pressure level has to be increased to, is derived from the temperature measurement system, that the evaporator and or economiser is equipped with or derived from a software model of the evaporator and or economizer.

Adjusting the water supply temperature for example comprises increasing the temperature with the target of enabling extended once-through operation at low load, for example based on the input obtained from a temperature measurement system 27, that the evaporator and or economizer are equipped with and/or a software model of the evaporator and/or economizer.

Adjusting the water supply temperature comprises in a preferred embodiment regulating the pressure within the extraction line 22. In fact, the preheater 21 is fed with superheated steam from the line 16; thus the steam supplied to the preheater 21 has the pressure of the steam passing through the line 16. The higher the pressure in the line 16, the higher the condensation temperature at the condenser 21 (because pressure and steam are linked in a two phase water-steam system). The temperature of the water supplied via the water supply 4 to the economizer 5 therefore depends on the steam pressure in the line 16.

Regulating the pressure within the extraction line 22 comprises adjusting the regulation valve 23 on the extraction line 22.

Alternatively or in addition the extraction line 22 can be connected to a source of high pressure fluid 26, wherein regulating the pressure within the extraction line 22 comprises adjusting the source of high pressure fluid 26; for example the mass flow of the high pressure fluid can be regulated, in order to adjust the steam condensation pressure at the preheater 21. For example the high pressure fluid can be steam from the superheater 11 and/or reheater 17 and/or from the inlet and/or outlet of the turbines 14, 19 and/or from the inlet and/or outlet of the evaporator 6 and/or economizer 5.

The live steam pressure in the system 13 and/or the temperature of the water fed via the water supply 4 can be adjusted in different ways.

The live steam pressure and/or water temperature can be controlled on the basis of the measured temperature; for example when the temperature measured at the evaporator falls or a non-homogeneous temperature over the evaporator and/or economizer is measured, the live steam pressure and/or water temperature are controlled in order to bring the evaporator and/or economizer back to a state of more homogeneous temperature deviation.

The live steam pressure and/or water temperature can be either derived from a measurement system 27 connected to the evaporator 6 and/or economizer 5 or can be derived from an evaporator/economizer software model, which calculates the limitations on the minimum pressure and/or the required live steam pressure and/or water supply temperature at the inlet of the economizer 5 and/or evaporator 6 required for extending once-through operation to lower loads with a certain heat influx profile. Also a combination of a measurement system 27 and an evaporator/economizer software model can be used.

With the evaporator inlet parameters (inlet temperature and evaporator pressure) being optimized, the required minimum evaporator flow can be reduced. This allows an extension of the once-through operation to lower load levels.

Naturally the features described may be independently provided from one another.

In practice the materials used and the dimensions can be chosen at will according to requirements and to the state of the art.

The invention claimed is:

1. A method for low load operation of a power plant having a once-through boiler and at least one high pressure turbine, the once-through boiler having a water supply and an economizer, an evaporator and a superheater, the at least one high-pressure turbine comprising a control valve, the method comprising:

providing at least one parameter indicative of stable operation of the once-through boiler in once-through operation, the at least one parameter obtained from a temperature and/or pressure measurement system and/or from a software model; and on the basis of the at least one parameter, (i) adjusting the control valve to regulate the pressure within the economizer and the evaporator and (ii) adjusting the temperature of the water supplied to the economizer, wherein low load is defined by a number of critical load values, and a number of partially open positions of the control valve are provided, each position being associated with a respective one of the number of critical load values, and when the load falls below a given load value of the number of critical load values, the method comprises adjusting the control valve to the partially open position associated with said given load value.

2. The method according to claim 1, wherein the step of adjusting the control valve comprises partially closing the control valve.

3. The method of claim 1, wherein the power plant further has an extraction line for supplying a part of steam discharged from the high-pressure turbine to a preheater for heating water supplied to an economizer, and the step of adjusting the temperature of the water supplied to the economizer further comprises regulating the pressure within the extraction line.

4. The method of claim 3, wherein the extraction line has a regulation valve, and wherein regulating the pressure within the extraction line comprises adjusting the regulation valve.

5. The method of claim 3, wherein the extraction line is connected to a source of high pressure fluid and regulating the pressure within the extraction line comprises adjusting the source of high pressure fluid.

6. The method of claim 1, wherein the at least one parameter comprises at least a temperature measured at the evaporator and/or economizer.

7. The method of claim 1, wherein the at least one parameter comprises a measured temperature spread between different tubes and/or tube bundles and/or tube sections of the evaporator and/or economizer.

8. The method of claim 6, wherein the at least one parameter comprises measuring a measured temperature or plurality of temperatures over at least a tube of the evaporator and/or economizer at different measurement points on the tube and/or different radiuses of the tube wall.

9. The method of claim 6, wherein the at least one parameter comprises a measured temperature fluctuation and/or temperature deviation of at least a tube of the evaporator and/or economizer over time.

10. The method of claim 1, wherein adjusting the temperature comprises increasing the water temperature supplied to the economizer.

11. The method of claim 1, wherein the once-through boiler has no valves between the economizer, the evaporator and the superheater.

* * * * *